US009510693B2

(12) United States Patent
Cordier et al.

(10) Patent No.: US 9,510,693 B2
(45) Date of Patent: Dec. 6, 2016

(54) BIDIRECTIONAL COMMUNICATION BETWEEN AN INFANT RECEIVING SYSTEM AND A REMOTE DEVICE

(71) Applicant: Mattel, Inc., El Segundo, CA (US)

(72) Inventors: Bruce Robert Cordier, West Seneca, NY (US); Kurt J. Huntsberger, Arcade, NY (US); John W. Taylor, Cowlesville, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/444,215

(22) Filed: Jul. 28, 2014

(65) Prior Publication Data

US 2015/0038072 A1 Feb. 5, 2015

Related U.S. Application Data

(60) Provisional application No. 61/861,019, filed on Aug. 1, 2013, provisional application No. 61/979,166, filed on Apr. 14, 2014.

(51) Int. Cl.
*A47D 15/00* (2006.01)
*A47D 9/00* (2006.01)
(Continued)

(52) U.S. Cl.
CPC ..... *A47D 15/00* (2013.01); *A47D 9/00* (2013.01); *G08B 21/0461* (2013.01); *G08B 21/0208* (2013.01)

(58) Field of Classification Search
CPC ..... A47D 9/00; A47D 9/02; A47D 13/10; A47D 13/105; A47D 13/107; A47D 15/00; G08B 21/0208; G08B 21/0202; G08B 21/0225; G08B 21/0227; G08B 21/0277; H04W 4/008; H04M 1/7253;H04M 2250/02; H04M 1/72533; A63H 30/04
See application file for complete search history.

(56) References Cited

U.S. PATENT DOCUMENTS 4,984,380 A 1/1991 Anderson
5,629,683 A 5/1997 Slomowitz et al.
(Continued)

FOREIGN PATENT DOCUMENTS

AU 2012101217 A4 9/2012
CN 1701733 11/2005
(Continued)

OTHER PUBLICATIONS

International Search Report PCT/US2014/048538, dated Nov. 12, 2014.

*Primary Examiner* — Bobbak Safaipour
*Assistant Examiner* — Devan Sandiford
(74) *Attorney, Agent, or Firm* — Edell, Shapiro & Finnan, LLC

(57) ABSTRACT

An infant device, such as in infant swing, establishes a wireless connection with a parent's existing portable electronic device, such as a smartphone. The portable electronic device sends messages to control any of the functions associated with the infant device. The portable electronic device also sends video and voice to be output at the infant device, allowing the child to remotely see and hear the parent's face and voice. The infant device sends messages with status information on the system enabling the portable electronic device to remotely monitor the system. The infant device also sends messages to the parent's existing portable electronic device containing audio and/or video information recorded from the child, allowing the parent to remotely see and hear the child in the system.

17 Claims, 9 Drawing Sheets

(51) Int. Cl.
*G08B 21/04* (2006.01)
*G08B 21/02* (2006.01)

(56) References Cited

U.S. PATENT DOCUMENTS 5,757,274 A 5/1998 Slomowitz et al.
5,774,861 A 6/1998 Spector
5,951,360 A 9/1999 Fearon et al.
6,043,747 A 3/2000 Altenhofen
6,084,527 A 7/2000 Spector
6,113,455 A 9/2000 Whelan et al.
6,116,983 A 9/2000 Long et al.
6,447,362 B2 9/2002 Khamphilavong et al.
6,462,664 B1 10/2002 Cuijpers et al.
6,686,843 B2 2/2004 Felkowitz
6,692,368 B1 2/2004 Hyun
6,759,961 B2 7/2004 Fitzgerald et al.
6,769,952 B1 8/2004 Drosendahl et al.
6,773,344 B1 8/2004 Gabai et al.
6,812,822 B1 11/2004 Spector
7,049,968 B2 5/2006 Fitzgerald et al.
7,172,486 B2 2/2007 Drosendahl et al.
7,378,974 B1 5/2008 Bassett et al.
7,425,901 B2 9/2008 Groover
7,470,167 B2 12/2008 Clark
7,476,142 B2 1/2009 Mastrosimone-Gese
7,551,100 B1 6/2009 Salley et al.
7,563,170 B2 7/2009 Bellows et al.
7,685,657 B1 3/2010 Hernandez et al.
7,762,865 B2 7/2010 Gelfond et al.
7,770,971 B2 8/2010 Bellows et al.
7,824,273 B2 11/2010 Clapper et al.
7,827,631 B2 11/2010 Holman
7,874,927 B2 1/2011 Godiska
7,883,426 B2 2/2011 Bellows et al.
7,927,171 B2 4/2011 Goszewski et al.
8,007,043 B1 8/2011 Vuong
8,029,377 B2 10/2011 Velderman et al.
8,083,601 B2 12/2011 Speedie
8,187,111 B2 5/2012 Velderman et al.
8,403,767 B2 3/2013 Zhang
8,602,904 B2 12/2013 Tuckey et al.
8,684,856 B2 4/2014 Pyrce et al.
2002/0008625 A1* 1/2002 Adams ..... G08B 21/0211 340/573.1
2003/0038725 A1* 2/2003 Slomowitz ..... A47D 7/02 340/686.1
2003/0153240 A1 8/2003 DeJule
2003/0171065 A1 9/2003 Greenberg
2004/0029557 A1* 2/2004 Pugliese ..... G08B 21/0208 455/404.2
2004/0130449 A1* 7/2004 Hung ..... A61M 21/00 340/573.1
2004/0259070 A1 12/2004 Goodstein
2005/0062588 A1 3/2005 Spector
2005/0122067 A1 6/2005 Lee
2005/0170744 A1 8/2005 Smith et al.
2005/0176461 A1* 8/2005 Bozzone ..... A61B 5/0002 455/551
2006/0052172 A1 3/2006 Stephen et al.
2006/0103516 A1* 5/2006 Zang ..... B60N 2/002 340/457
2006/0194506 A1 8/2006 Sacchetti
2006/0220884 A1 10/2006 Thompson
2006/0260663 A1 11/2006 Sejnowski et al.
2006/0264148 A1 11/2006 Sejnowski et al.
2007/0200695 A1* 8/2007 Almstrand ..... G08B 21/0202 340/539.13
2007/0200714 A1 8/2007 Smith et al.
2008/0016624 A1 1/2008 Osborn
2008/0020672 A1 1/2008 Osborn
2008/0060129 A1 3/2008 Massa
2008/0136236 A1* 6/2008 Kincaid ..... A47D 9/02 297/260.2
2008/0139327 A1* 6/2008 Clapper ..... A47D 9/02 472/118
2008/0146361 A1 6/2008 Godiska
2008/0217974 A1* 9/2008 Velderman ..... A47D 9/02 297/256.16
2009/0018841 A1 1/2009 Leeds et al.
2009/0040044 A1* 2/2009 Chiao ..... A61B 5/0002 340/540
2009/0062622 A1 3/2009 Lin
2009/0070929 A1 3/2009 Holman
2010/0060448 A1* 3/2010 Larsen ..... A63H 33/006 340/539.15
2010/0240277 A1 9/2010 Rapp
2010/0241018 A1* 9/2010 Vogel ..... A61B 5/0002 600/511
2011/0014847 A1 1/2011 Fingerer et al.
2011/0025915 A1 2/2011 Daban
2011/0053129 A1* 3/2011 Basson ..... G09B 19/00 434/238
2011/0230115 A1 9/2011 Wang et al.
2011/0312350 A1* 12/2011 Agerholm ..... G08B 13/196 455/466
2012/0046102 A1 2/2012 Tully
2012/0062735 A1 3/2012 Rivera
2012/0119549 A1 5/2012 Speedie
2013/0033363 A1* 2/2013 Gabara ..... G01S 5/30 340/8.1
2013/0065478 A1 3/2013 Gunter et al.
2013/0107029 A1* 5/2013 Knasel ..... H04N 7/188 348/77
2013/0182107 A1* 7/2013 Anderson ..... G08B 21/02 348/143
2013/0184088 A1* 7/2013 Haut ..... A47D 13/10 472/119
2013/0280985 A1 10/2013 Klein
2014/0015760 A1* 1/2014 Aran Urbainczyk . G06F 1/1684 345/173
2014/0137324 A1* 5/2014 Doering ..... A47D 9/00 5/93.1
2014/0144346 A1* 5/2014 Houston ..... B62B 9/22 105/50
2014/0250592 A1* 9/2014 Karp ..... A47D 9/02 5/108
2014/0265480 A1* 9/2014 Perrin ..... B60N 2/26 297/217.4
2015/0009029 A1* 1/2015 Martin ..... A61B 5/7405 340/539.15
2015/0045608 A1* 2/2015 Karp ..... A61M 21/02 600/28

FOREIGN PATENT DOCUMENTS

CN 201664114 U 12/2010
CN 201790390 U 4/2011
CN 202567321 U 12/2012
DE 10321129 A1 4/2005
JP 2003311034 A 11/2003
JP 2005185630 A 7/2005
WO 2010060010 A1 5/2010
WO WO 2013059625 A1 * 4/2013 ..... A47D 9/02

* cited by examiner

BIDIRECTIONAL COMMUNICATION BETWEEN AN INFANT RECEIVING SYSTEM AND A REMOTE DEVICE

CROSS-REFERENCE TO RELATED APPLICATIONS

This application claims priority to and the benefit of U.S. Provisional Patent Application No. 61/861,019, filed Aug. 1, 2013, entitled "Bidrectional Communication between an Infant Receiving System and a Remote Device," and U.S. Provisional Patent Application No. 61/979,166, filed Apr. 14, 2014, entitled "Bidrectional Communication between an Infant Receiving System and a Remote Device," the contents of each of which is hereby incorporated by reference in full.

FIELD OF THE INVENTION

The present invention relates to communicating with an infant receiving system. More specifically, the present invention relates to a wireless link between an infant receiving apparatus and a parent's existing portable electronic device.

BACKGROUND OF THE INVENTION

Existing infant receiving systems, e.g., swings, cribs, bouncers, high chairs, entertainers, playpens, bassinets, etc., come with a variety of accessories and features intended to entertain a child and keep their attention. Another goal of infant receiving systems is to soothe and pacify a child with motion, sounds, or lights. The various controls for the infant receiving system and/or accessories, including music, sound effects, visual effects, mobiles, speed, vibration, etc., are generally controlled locally (at the device) or with a purpose-built, dedicated, remote control device.

Some infant receiving systems have programmed sensors to respond to a child's crying or other remotely sensed input, and start one of the functions of the system to calm and soothe the child. U.S. Pat. Nos. 6,916,249 and 6,561,915, the disclosures of which are hereby incorporated by reference, both describe infant swings that start the swinging motion in response to detecting a child's cry. However, these responses are preprogrammed and inherently local interactions.

As the number and variety of infant receiving devices and accessories grow, parents have a need for more comprehensive control over these devices. Two-way communication between the infant receiving device and the parents' existing portable electronic devices offers a versatile and expandable way of remotely controlling the infant receiving devices and accessories.

SUMMARY OF THE INVENTION

According to at least one embodiment of the present invention, a method for providing bidirectional wireless communication between an infant receiving system and a parent's portable electronic device includes establishing a wireless connection and monitoring for messages and commands that need to be sent back and forth across the wireless connection. The messages sent from the parent's portable electronic device can include commands for initiating actions, voice, and/or video messages. Messages sent to the parent's portable electronic device can include status information, sound data, video data, or other environmental information associated with the infant receiving system and the infant received therein.

BRIEF DESCRIPTION OF THE DRAWINGS

Like reference numerals have been used to identify like elements throughout this disclosure.

DETAILED DESCRIPTION OF THE INVENTION

Figure 1:
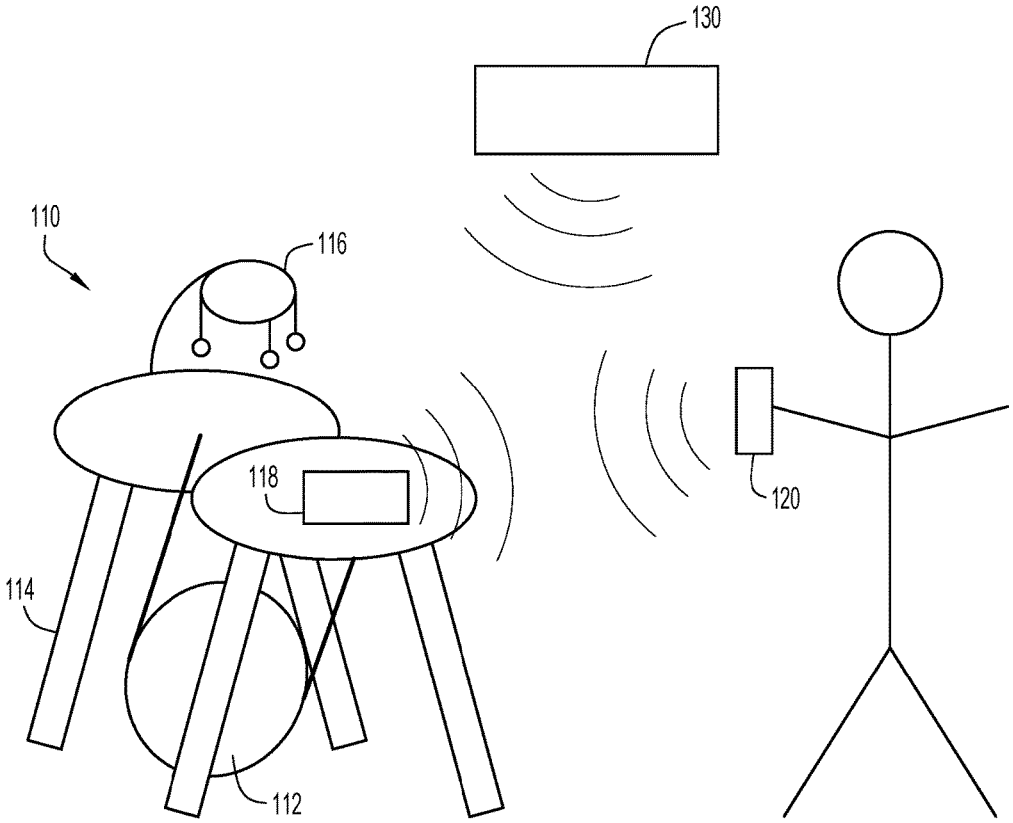
FIG. 1 shows an exemplary embodiment of an infant receiving system (illustrated as a swing) communicating with a parent's portable electronic device in accordance with the present invention.

Referring to FIG. 1, one embodiment of an infant receiving system is shown as swing 110. Other embodiments include, but are not limited to, high chairs, bouncers, cribs, bassinets, entertainers, and play pens. Swing 110 includes seat 112 suspended from frame 114. Seat 112 is designed to safely and comfortably receive an infant therein. Optionally, mobile 116 may be connected to frame 114 so that it hangs in view of seat 112. Other accessories, including any other type of entertainment device, may be included in place of, or in addition to, mobile 116. Swing 110 further includes an electronics module 118 that controls the functions of swing 110 and mobile 116. In one embodiment, the electronics module 118 controls the speed of swinging movement of seat 112, the output of mobile 116, as well as any sound, music, visual effects, or vibration that swing 110 uses to capture the attention of a child. Exemplary embodiments of electronics module 118 are described below with respect to FIGS. 2 and 9.

Figure 2:
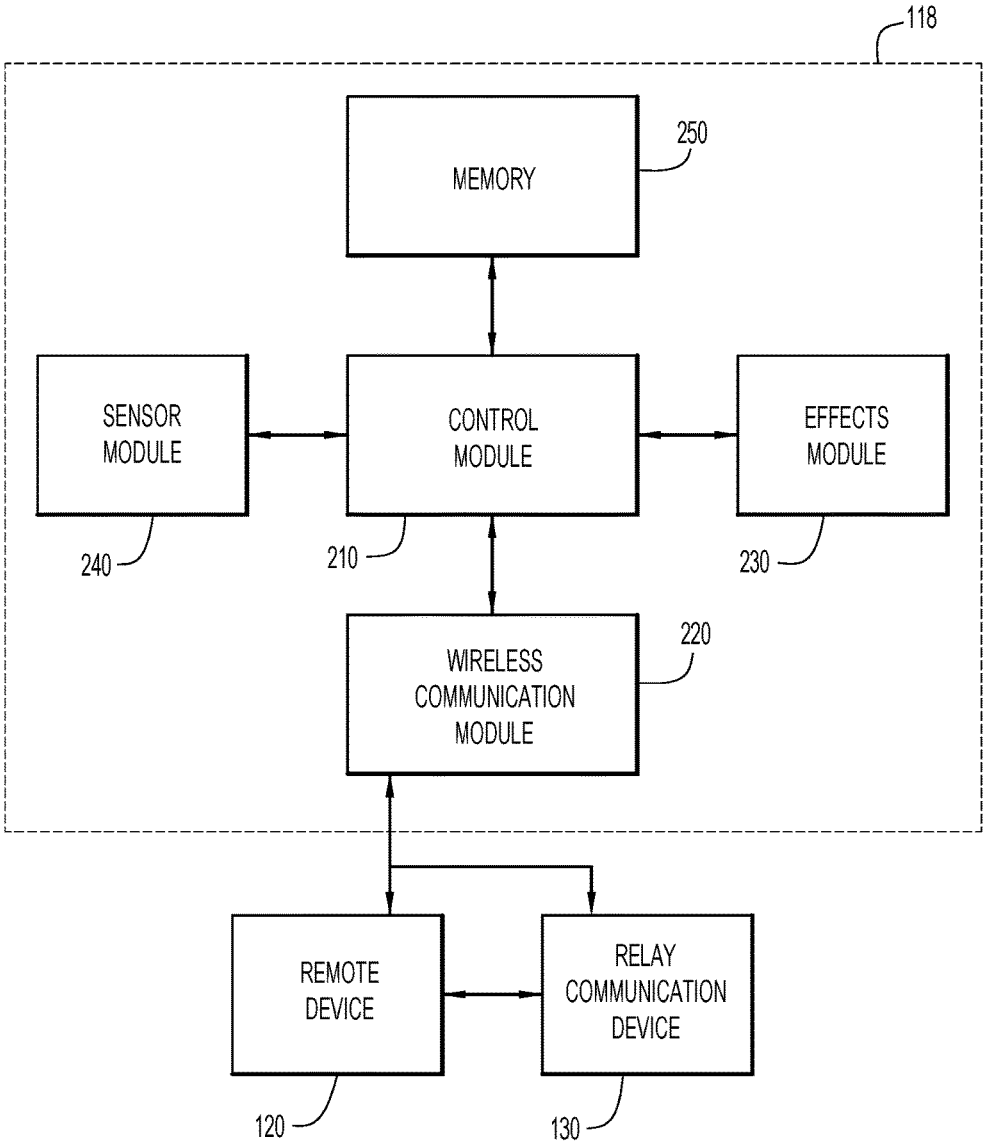
FIG. 2 shows a block diagram of one embodiment of the electronic modules used in communicating between an infant receiving system and a portable electronic device in accordance with the present invention.
Figure 9:
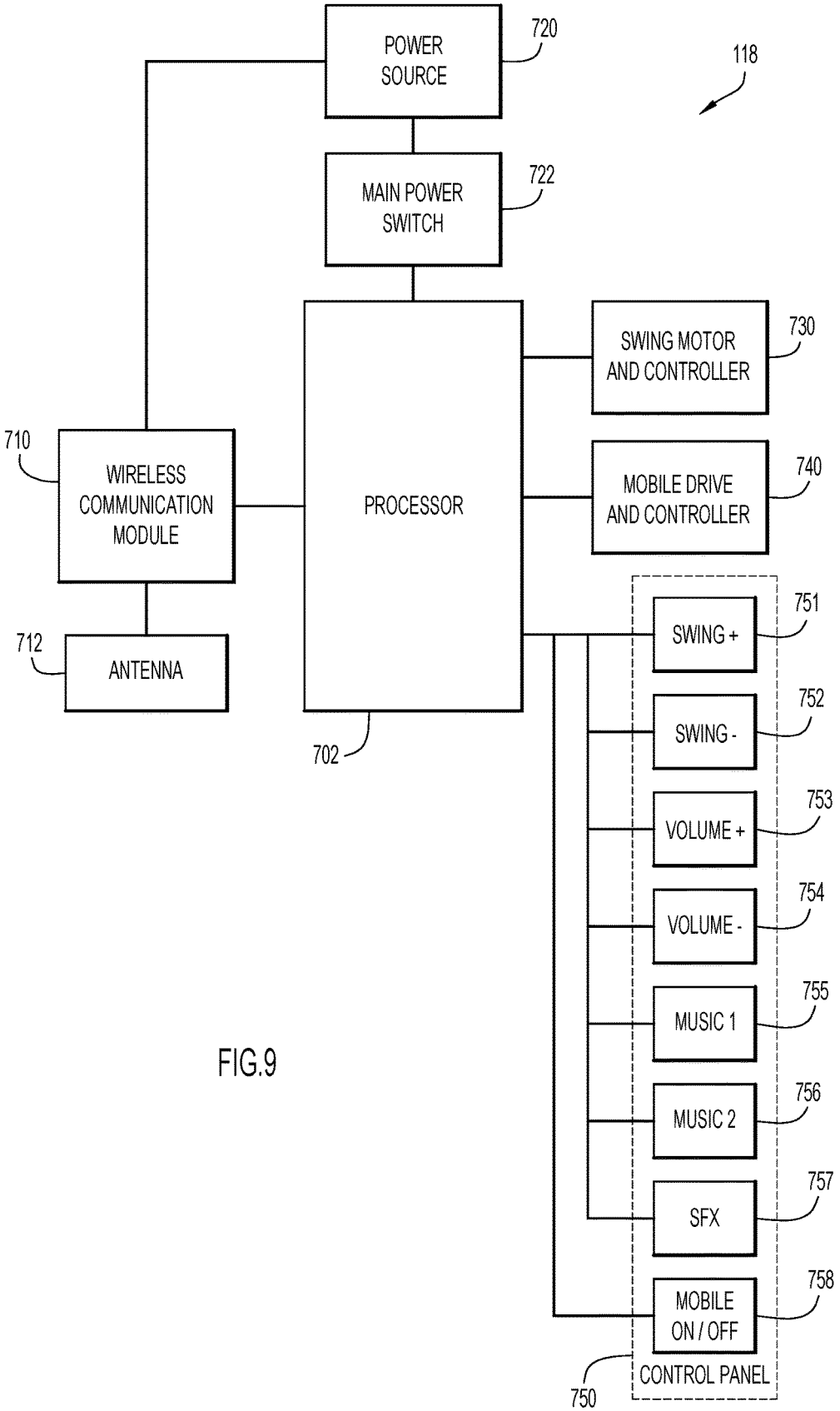
FIG. 9 shows a block diagram of an electronics module included in one embodiment of an infant receiving device according to the present invention.

As seen in FIGS. 2 and 9, the electronics may also include a wireless communication module 220, 710 to establish a wireless connection with the parent's portable electronic device 120. In one embodiment, portable electronic device 120 is a parent's smartphone. While the electronics module 118 is depicted on frame 114 of the swing 110, other arrangements may be envisioned without departing the scope of the invention. Additionally, the electronics module 118 may be separated into multiple sections, which may be located on different parts of swing 110. For example, in some embodiments, wireless communication module 220, 710 is directly integrated into the electronics module 118 of a swing 110, but in other embodiments, the wireless communication module 220, 710 may be a separate module that is detachably coupled to the electronics module 118 and power supply (e.g. power source 720, as shown in FIG. 9) of swing 110, allowing the wireless communication module 220, 710 to be used with a variety of different types of infant receiving devices.

In one embodiment, the wireless connection between the electronics module 118 and the parent's portable electronic device 120 may be established (via wireless communication module 220, 710) over Bluetooth Smart or Bluetooth LE, but may also be established over any standard wireless protocol (e.g., Bluetooth Classic, IEEE 802.11, SMS/MMS, etc.). The wireless connection can be established directly from the electronics module 118 of the infant receiving device (via wireless communication module 220, 710) to the parent's portable electronic device 120 or the connection may be made through relay device 130, such as a wireless router. Once established, the wireless connection enables bidirectional communication between the electronics module 118 of the infant receiving device and the parent's portable electronic device 120. In one example, the wireless connection between the parent's portable electronic device 120 and the electronics module 118 is a client-server connection with the parent's portable electronic device 120 querying electronics module 118 for information. Alternatively, the electronics module 118 may act as the client and query the parent's portable electronic device 120 for information.

Referring now to FIG. 2, a block diagram shows the connections between the bidirectionally communicating elements of the present invention. In one embodiment, the electronics module 118 of the infant receiving device includes control module 210, wireless communications module 220, effects module 230, sensor module 240, and memory 250. Some or all of the modules that comprise electronics module 118 may be packaged in combination and/or be combined in a single integrated circuit. Control module 210 controls and coordinates all of the functions of swing 110, including any accessories such as mobile 116. Wireless communications module 220 establishes the wireless connection and provides bidirectional communication between a parent's portable electronic device 120 and the control module 210.

Effects module 230 may enable control module 210 to play music, sounds, visual effects, and vibration. Conventional lighting assemblies and speakers are provided to produce any effects generated locally or reproduce effects transmitted from and provided by portable electronic device 120 through wireless communications module 220. In one example, a parent can speak to the child, either as a recorded voice message or a live conversation, by speaking into portable electronic device 120 and having their voice reproduced to the child by effects module 230. In another example, effects module 230 may include a display screen, and images and live or recorded video, such as a parent's face can be displayed to the child on the display screen. In a further example effects module 230 may control the speed of swing 110.

Sensor module 240 may include sensors to monitor the infant environment (e.g. the area around and within swing 110). In one embodiment, sensor module 240 may include a microphone to detect, record, and process sounds that the child makes. Sensor module 240 may also include a camera to capture images or video of the child in swing 110. Sensor module 240 may further include a weight sensor to measure the infant's weight. Any of the sounds, images, or other environmental factors detected by sensor module 240 while monitoring the infant environment may be sent via the wireless communications module 220 to the parent's portable electronic device 120. In one example, sensor module 240 includes a sound/activity detection circuit that monitors the infant environment and may send an alert to the parent's portable electronic device 120 if sensor module 240 detects that the infant is engaged in a specific activity (e.g., crying, waking up, etc.). In some embodiments, the sound or movement must meet a certain threshold in order to prevent false alerts from being sent to the parent's portable electronic device 120. Sensor module 240 may also include sensors to detect the activity of swing 110, and provide feedback to the parent's portable electronic device 120 if, for example, swing 110 is stalled.

Control module 210 may initiate actions based on input that sensor module 240 detects. In one embodiment, control module 210 sends a message to parent's portable electronic device 120 in response to sensor module 240 detecting that the child is crying. Control module 210 may also initiate actions that are preprogrammed in response to input from sensor module 240. In one embodiment, control module 210 directs effects module 230 to start movement of swing 110 or mobile 116 in response to sensor module 240 detecting that the child is crying. Additionally, although not shown, in other embodiments, the control module 210 may also interact with any systems included in a home (e.g., smart lighting systems, smart thermostat systems, smart household control systems, etc.). Thus, in some embodiments, the control module 210 may turn on lights in the nursery in response to sensor module 240 detecting that the child is crying.

Memory 250 may comprise read only memory (ROM), random access memory (RAM), magnetic disk storage media devices, optical storage media devices, flash memory devices, electrical, optical, or other physical/tangible memory storage devices. Control module 210 may be, for example, a microprocessor or microcontroller that executes instructions for operating the functions of electronics module 118. Thus, in general, the memory 250 may comprise one or more tangible (non-transitory) computer readable storage media (e.g., a memory device) encoded with software comprising computer executable instructions and when the software is executed (by control module 210) it is operable to perform the operations described herein in connection with control module 210, wireless communications module 220, effects module 230, and/or sensor module 240.

Figure 3:
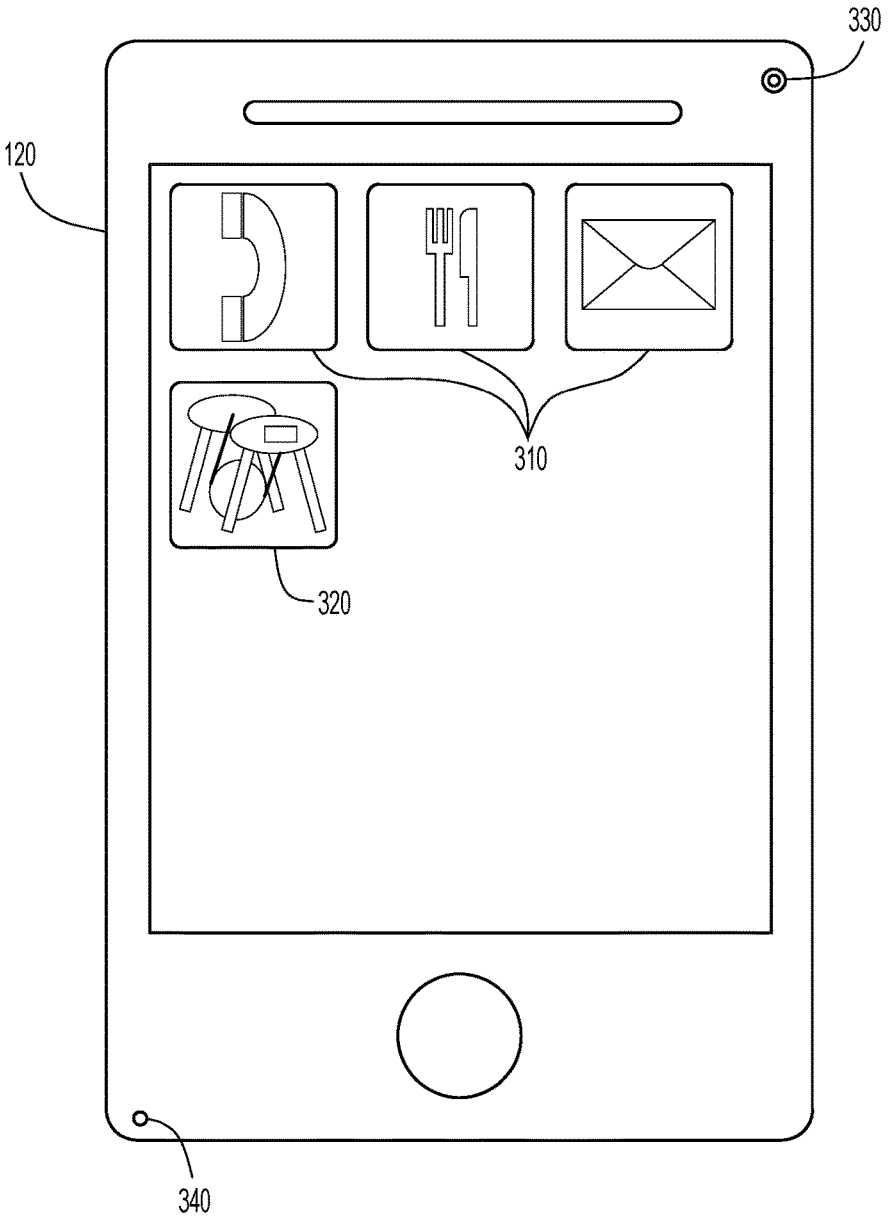
FIG. 3 shows one embodiment of the parent's portable electronic device used to communicate with the infant receiving system in accordance with the present invention.

Now referring to FIG. 3, one embodiment of a parent's portable electronic device 120 is shown. In this particular embodiment, the parent's portable electronic device 120 is a smartphone with applications ("apps") 310 for performing various functions of device 120. The parent's portable electronic device 120 also includes app 320 for communicating with the infant receiving device (in this particular example, swing 110). Through app 320, a parent can remotely view and control all of the functions of swing 110 (e.g., on/off, timer, speed of motion, music, sound and visual effects, vibration, etc.), including operations of mobile 116, from their portable electronic device 120. In one example, app 320 also includes a battery level indicator to view the charge left in the battery of swing 110. In another example, app 320 can be used to download and/or stream music from the parent's portable electronic device 120 to memory 250, or vice-versa (e.g. music may be downloaded from the swing 110 to the memory of the device 120), to be played back at a later time. App 320 may also receive input from camera 330 and microphone 340 of the parent's portable electronic device 120 to send voice and/or video messages to swing 110, where the messages can be reproduced for the child. An indication of any input detected by sensor module 240 can also be displayed by app 320 on the display screen of the parent's portable electronic device 120.

App 320 may also include the ability to customize a response to alerts generated by electronics module 118. In one example, sensor module 240 detects that the infant is crying and sends an alert through wireless communications module 220 to app 320 on a parent's portable electronic device 120. In response to the alert that the infant is crying, app 320 may direct swing 110 to play the infant's favorite music and start the swing in motion at a slow speed. Other examples of customized functions that app 320 may perform include directing effects module 230 to play a specific audio automatically whenever swing 110 is moving or directing a home lighting system to turn on the lights in a nursery after a certain length of time.

In addition to relaying commands back and forth between swing 110 and the parent's portable electronics device 120, app 320 can learn which settings the parent uses most often, and use those as default settings. App 320 may also learn based on data received from the swing 110. For example, when sensor module 240 detects that the infant in the swing 110 is crying and sends an alert, app 320 can adjust various parameters of the swing 110 (e.g., swing speed, music type and volume, etc.) until sensor module 240 reports that the infant is no longer crying. App 320 may store the parameters that worked in soothing the infant in this instance and use that stored data in the future when the infant cries again.

App 320 may further store data on use of swing 110. For example, app 320 may store data on how long the swing is used per use, how often the swing is used, and what swing parameters are typically used. This data may be used by the parent, or it may be sent to a third party (e.g., the manufacturer) to analyze usage. Additionally, data of this type could be used to create "Favorite" routines that a parent can create which include the parent's favorite input parameters so that the parent can execute multiple functions on the swing 110 with the touch of a single screen icon on the parent's portable electronic device 120. Such "Favorite" routines could also be directly entered into the app 320 on the portable electronic device 120 by the parent.

Figure 4:
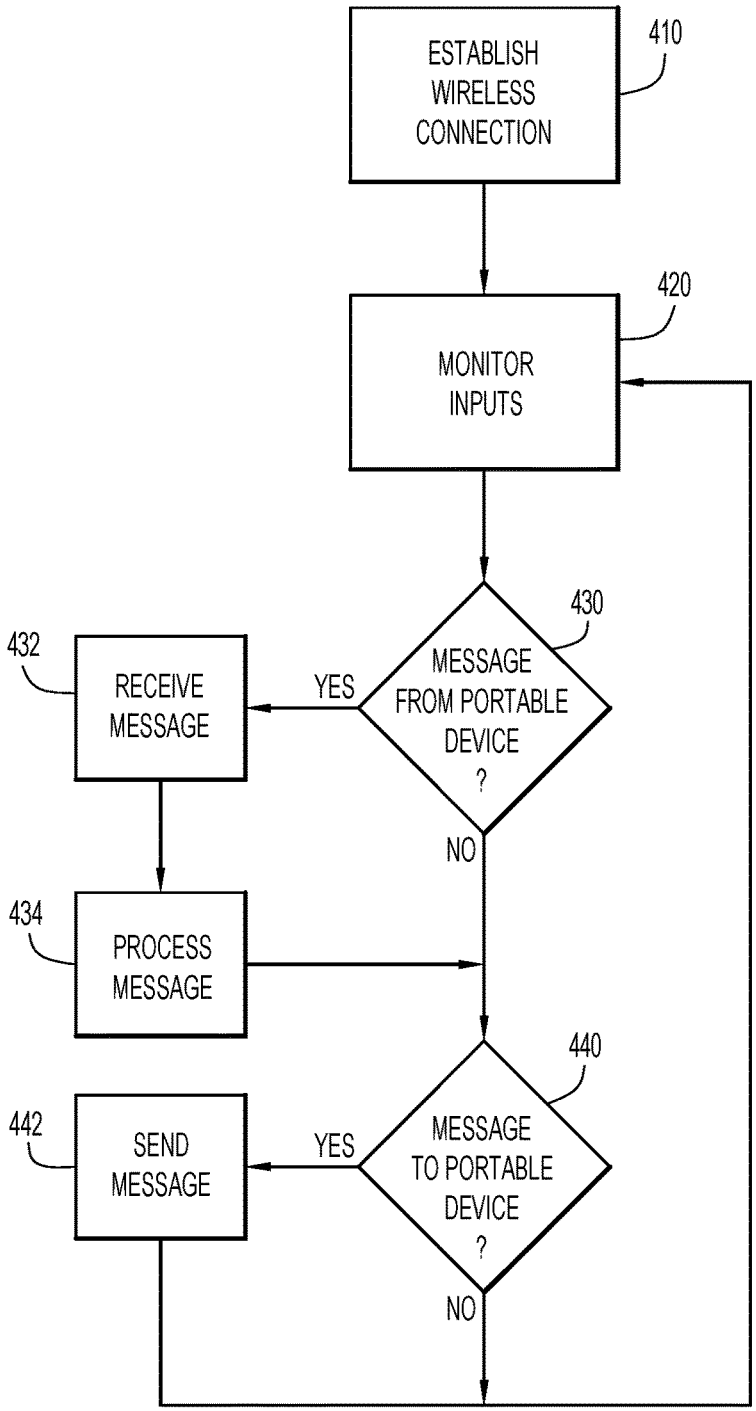
FIG. 4 shows one embodiment of a flow diagram associated with a method for using a wireless connection to communicate between a portable electronic device and an infant receiving system in accordance with the present invention.

Referring to FIG. 4, a method for establishing and using the wireless connection between parent's portable electronic device 120 and swing 110 in accordance with the present invention is illustrated. At step 410, wireless communications module 220 establishes a wireless connection between swing 110 and portable electronic device 120. In one embodiment, the wireless connection is established with a Bluetooth LE or Bluetooth Smart pairing. At step 420, control module 210 monitors the input from all of the other modules coupled to it. If there is a message coming from parent's portable electronic device 120 through wireless communications module 220 (step 430), control module 210 instructs wireless communications module to receive the message at step 432. Control module 210 processes the received message at step 434, and takes any action indicated in the received message, using any of the modules coupled to control module 210. In one embodiment, parent's portable electronic device 120 sends a message indicating that mobile 116 should begin movement. The message is received by wireless communications module 220, and processed by control module 210, which then instructs mobile 116 to begin movement.

If control module 210 receives an input that there is a message to send to portable electronic device 120 (step 440), then control module 210 instructs wireless communications module 220 to send the message at step 442. In one embodiment, control module 210 receives input from sensor module 240 that indicates the child in the swing 110 is crying and a message should be sent to parent's portable electronic device 120. Control module 210 instructs wireless communications module 220 to send a message to parent's portable electronic device 120, and may include an audio and/or video recording of the input that caused the message to be sent.

After determining if any messages are to be sent or received, the method loops back to step 420 and control module 210 continues to monitor its inputs for messages to or from parent's portable electronic device 120.

Figure 5:
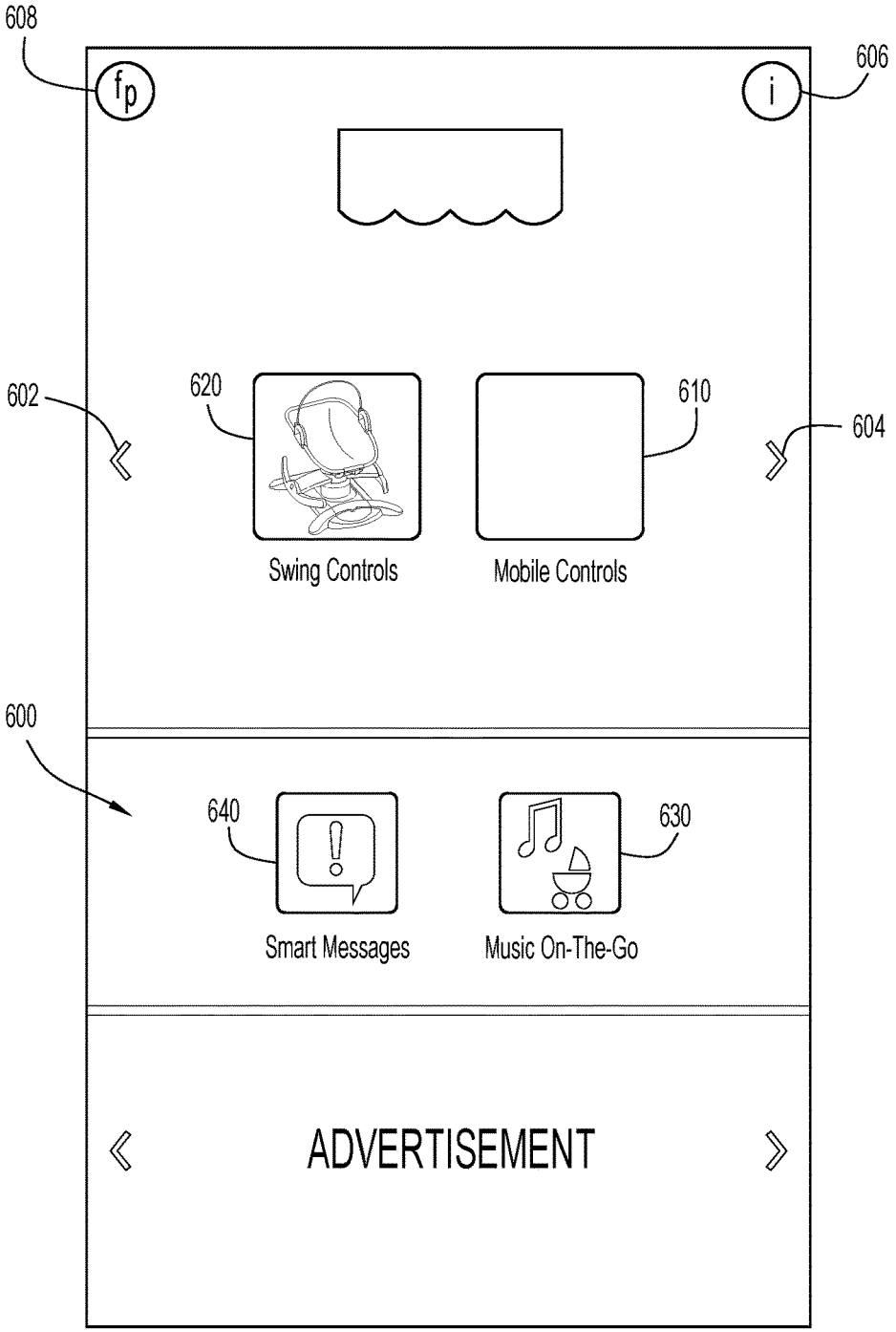
FIGS. 5-8 show screenshots of embodiments of the menu, controls, and indicators provided by an app of the present invention on an exemplary portable electronic device.
Figure 6:
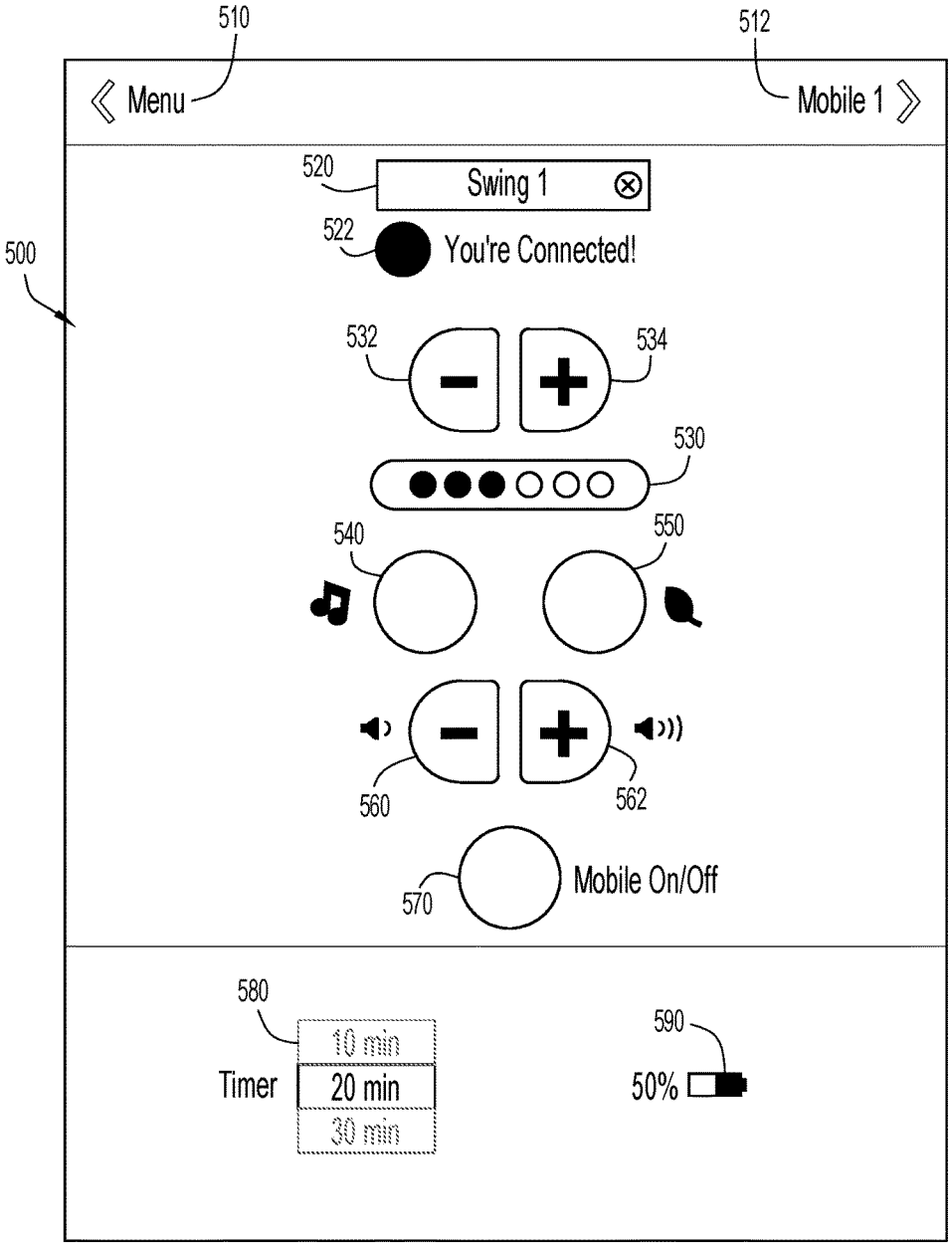
Figure 7:
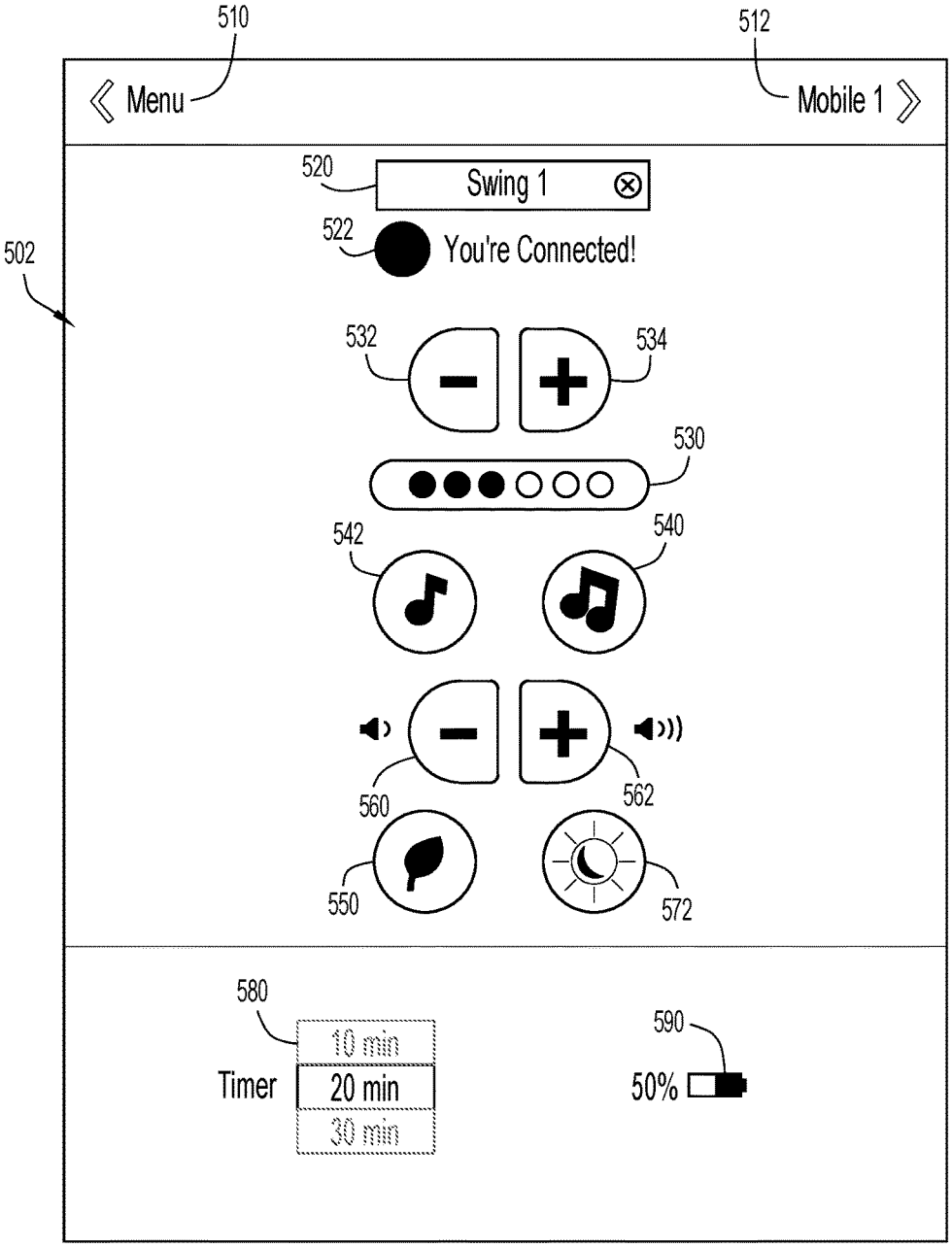
Figure 8:
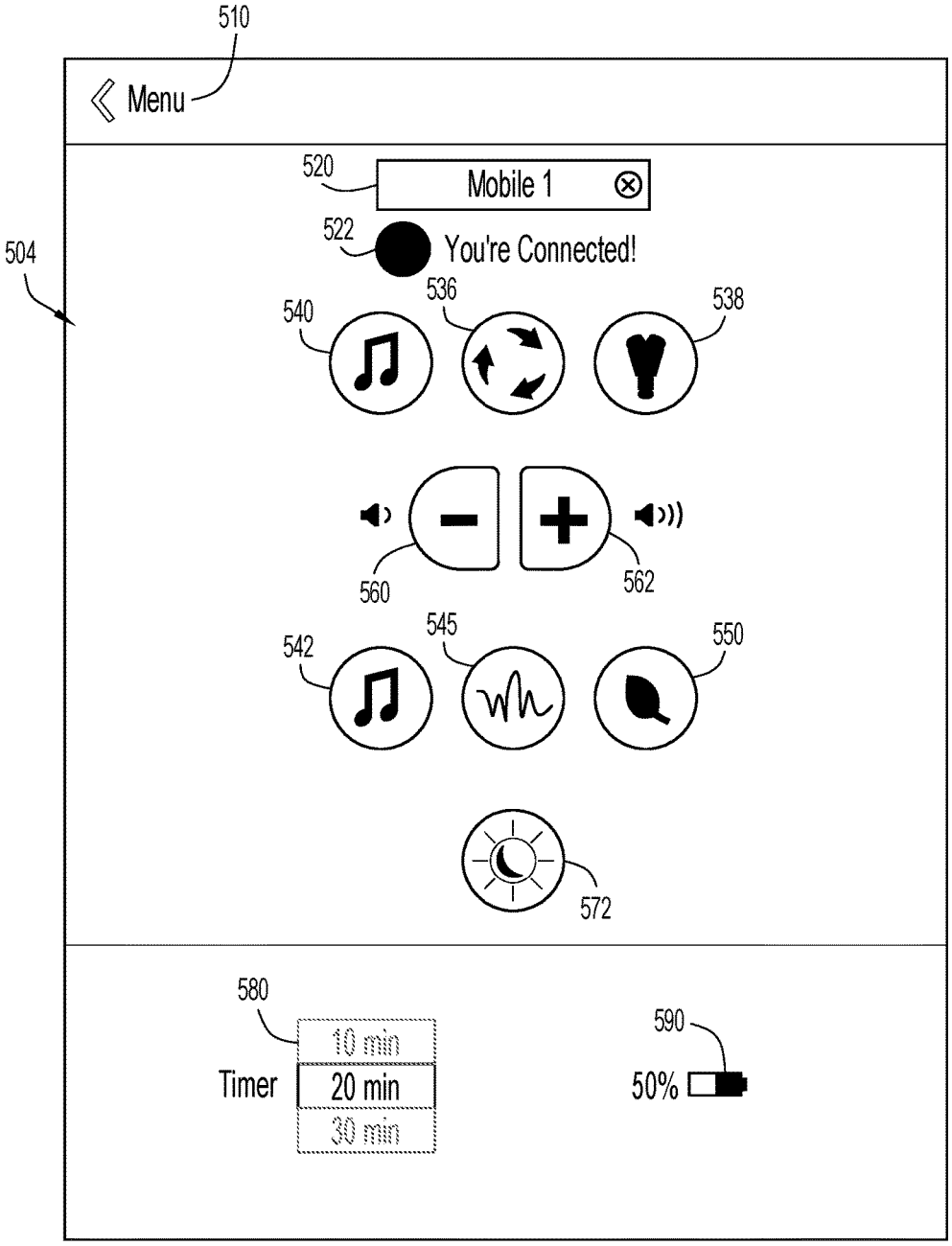

Referring now to FIGS. 5-8, screenshots of one embodiment of the controls and indicators provided by app 320 are shown on an exemplary parent's portable electronic device 120. As can be seen, in this embodiment, the app 320 provides multiple menus which allow a parent to navigate between control screens for various infant receiving devices and/or mobiles. In particular, FIG. 5 shows an exemplary embodiment of a menu or home screen for the app 320, FIG. 6-7 show two exemplary embodiments of a control screen for a swing, and FIG. 8 shows an exemplary embodiment of a control screen for a mobile.

As can be seen in FIG. 5, the home screen of the app 320 provides icons 610, 620, 630, and 640 and buttons 606 and 608 which allow a user to navigate between various control screens, modes, information, and activities provided by the app 320. In this embodiment, icon 640 allows a user to toggle messages on or off, icon 630 allows a user to access "Music on-the-go" mode, and icons 610 and 620 are device icons. Briefly, toggling smart messages on or off via icon 640 allows or prevents, respectively, the app to provide notifications, smart messages (e.g. messages produced based on detected information), or other such alerts (e.g. push notifications) to a user on the parent's portable electronic device 120. For example, a message may alert a user that an infant receiving device (e.g. swing 110) is disconnected from the portable electronic device 120, a timer is almost up, and other such messages described herein. The music on-the-go mode associated with icon 630 allows a parent, from their portable electronic device 120, to access music and/or playlists included on an infant receiving device (e.g. swing 110), on the parent's portable electronic device 120, or in the cloud in order to remotely provide soothing music to the child in . Thus, as an example, a parent may play their child's "sleeping" playlist when putting their child to sleep away from his or her swing. When in this mode, the portable electronic device 120 may display soothing images, animations, or any other desirable images to the child.

Now turning to the device icons 610, 620, icon 610 is associated with the mobile controls and icon 620 is associated with the swing controls. In some embodiments, the device icons may be presented as grayscale images unless the portable electronic device is connected to the particular infant device represented by the device icon. When an infant device is connected to the portable electronic device 120, the icon may change to a color icon. If the device icons are grayscale, or otherwise show that a particular infant device is not connected to the parent's portable electronic device 120, a user may tap the appropriate icon while pressing a pairing button on the infant device in order to pair the devices. Alternatively, in some embodiments, a parent's portable electronic device 120 and an infant device may be paired when a parent moves their portable electronic device 120 within range of, or into contact with, (e.g., "bump" or "kiss" to pair) or otherwise proximate to the desired infant device. In some embodiments, if the parent's portable electronic device 120 and infant device have already been paired, a parent may simply move their portable electronic device 120 within range of the desired infant device in order to connect their portable electronic device 120 to an infant device, regardless of how the initial pairing was effectuated. In some embodiments, a message alerting a user to "Tap the Swing or Mobile icon above to connect" may appear if no infant devices are currently paired with the parent's portable electronic device 120.

Once an infant device is paired with the parent's portable electronic device 120, a user may press a device icon in order to access a device's controls. Additionally or alternatively, in some embodiments, the appropriate controls may be automatically presented to a user or parent when pairing between an infant device and the portable electronic device 120 is successfully completed. Thus, in some embodiments, it may not be necessary for a user to select one of the device icons to access the control screen within the app 320. Additionally, if a user has used or connected his or her portable electronic device 120 to more than two infant devices, the scroll arrows 602, 604 may allow the user to scroll through all of their devices (e.g. the arrows may rotate the icons in a carousel manner, either backwards or forwards) in order to view and/or access any desirable infant device icons. In some embodiments, a parent may pair their portable electronic device with any desirable number of infant devices at any given time, but in other embodiments, a parent may only pair their portable electronic device to one infant device at a time. Thus, in some embodiments, multiple device icons may be presented in color and a parent may simply tap different icons to access different controls for different paired devices, but in other embodiments, only one icon may be presented in color at any given time and a parent may need to disconnect, either manually or automatically, from a first infant device in order to pair or re-pair with a second infant device (in some embodiments, pairing with a second infant device may automatically disconnect the pairing with the first infant device).

Still referring to FIG. 5, the home screen of the app 320 may also include informational buttons 606 and 608 that may allow a user to view instructions, help, FAQ's and other such information. Information provided by button 608 may be stored locally within the app 320 or the user's portable electronic device 120. By comparison, button 606 may also provide information relating to the app 320, but button 606 may provide links to web pages that include this information. For example, button 606 may includes links to instructional videos to assist with pairing an infant device and portable electronic device 120, instructions manuals for various infant devices, social media pages related to any desirable product or company, and any other desirable information. As an example, button 606 may be an "F-P" logo and may direct a user to a FISHER-PRICE social media page. As illustrated at the bottom of FIG. 5, the app 320 may also include product advertisements for devices that may be purchased that are compatible with both the app 320 and the parent's portable electronic device 120.

Now turning to FIGS. 6-8, each of FIGS. 6-8 provides a screenshot of an embodiment of controls and indicators (also referred to as control screens) for an infant device (including an infant receiving device) that may be provided by app 320 on a portable electronic device 120. In particular, FIG. 6 provides a screenshot of a first embodiment of a control screen 500 for an infant swing 110, FIG. 7 provides a screenshot of a second embodiment of a control screen 502 for an infant swing 110, and FIG. 8 provides a screenshot of an embodiment of a control screen 504 for a mobile. Notably, each of the control screens 500, 502, 504 includes substantially similar features, which are described below.

As seen in FIGS. 6-8, each control screen includes at least one navigation control 510 and may also include a second navigation control 512 to allow a user to navigate between a plurality of screens in app 320. Additionally, each control screen 500, 502, 504 includes a device indicator 520 that shows which device 110 (e.g., "Swing 1") is configured to be connected to the parent's portable electronic device 120 (where multiple devices may be in range and available for connection to the parent's portable electronic device 120 via the app 320). In some embodiments, the device indicator 520 may be edited by a user in order to give each product controlled by the portable electronic device a personalized or more recognizable name. For example "Swing 1" may re-named as "Henry's Swing," "Madeline's Swing," "Stephen's Glider," etc., such that a parent can easily identify different infant devices used for different children or used in different situations (e.g. playroom swing, bedroom swing, grandma's house, nursery mobile). The navigation buttons 510, 512 may allow a parent to easily move between different devices and/or the home menu.

Next, the control screens shown in FIGS. 6-8 also includes a connection indicator 522 that may confirm the connection between app 320 and the infant device and show confirmation to the user of portable electronic device 120. In some embodiments, the connection indicator 522 may provide graphic (including color) confirmation in addition to or instead of textual confirmation. For example, in some embodiments, the connection indicator 522 may appear red and provide a message "You're Not Connected" when the portable electronic device 120 is not connected to the particular infant device shown in the device indicator 520. Then, if a user pairs the devices 110, 120 (e.g. by moving into range), the connection indicator 522 may turn yellow and flash, strobe, or otherwise indicate it is working, while a message "Connecting . . . " appears adjacent the connection indicator 522. Once connected, the connection indicator 522 may turn green and be accompanied by the message "You're Connected!" (as shown in the screenshots provided in FIGS. 6-8). In addition to providing an indication of connection status, connection indicator 522 may also serve as a connect/disconnect button. Thus, when initially pairing the portable electronic device 120 with an infant device, a user may press this button (after the initial pairing, the pairing may be initiated automatically). Alternatively, if a user wishes to disconnect (perhaps to allow another user to connect while both users remain in range of the infant receiving device), the disconnecting user may press indicator 522.

Still referring to FIGS. 6-8, some control panels, such as control panels 500, 502 and any other control panels associated with infant receiving devices 110 that have speed controls, may include a speed indicator 530. Speed indicator 530 shows the speed setting that an infant receiving device 110 is currently set at, and the speed of the infant receiving device 110 is adjustable with speed control buttons 532 and 534. In this particular embodiment, the swing 110 may be set at one of six speed levels. By comparison, mobile control screen 504 simply includes a motion button 536 that either turns the motion of the stand-alone mobile device on or off, with no speed adjustments. Additionally, the mobile control screen 504 also includes a projection button 538 which allows a mobile projection system to be toggled on and off.

Each control screen 500, 502, 504 also allows audio output to be controlled remotely, albeit each control screen 500, 502, 504 includes a slightly differently interface. Control screen 500 includes a music button 540, a nature sounds button 550 and audio volume controls 560 and 562. By comparison, control screens 502 and 504 each include volume controls 560 and 562 and a nature sounds button 550, but also include additional audio options. Specifically, control screen 502 includes a first music button 540 that provides lullaby music, and a second music button 542 that provides active music while control screen 504 includes an audio output on/off button 540 and three audio output options: music button 542, white noise button 545, and nature sounds 550. However, in other embodiments, any desirable audio options may be included on a control screen.

App 320 may additionally comprise a timer element 580 that turns off some or all of the functions of the remote device after a selected amount of time (e.g., 20 minutes). In some embodiments, the timer element 580 may be used to control at least one of the motion of the infant receiving device and the audio output. For example, in some embodiments, a user may remotely set an infant receiving device to remain in motion for thirty minutes, sixty minutes, ninety minutes, or continuously and may separately set the audio output to run for fifteen minutes, thirty minutes, forty-five minutes, sixty minutes, or continuously. In such embodiments, default settings that keep the infant receiving device in motion continuously and play audio output for thirty minutes may be preprogrammed into the app 320. The battery state of the remote device may also be monitored by app 320 and displayed to a user with battery indicator 590. In some embodiments, if either the battery of the remote device or the timer is running low, a message may be provided to the user at the portable electronic device 120. For example, upon detection that an infant receiving device has 5% or less of its battery life left or that a timer for motion or music has 30 seconds or less left, a message may be sent to the portable electronic device 120 to alert a user.

In addition to the aforementioned features, a control panel may also include buttons to activate, adjust, or otherwise control any additional features on a remote infant device. For example, control screen 500 includes a mobile control button 570 to allow a powered mobile 116, if included with the infant receiving device, to be turned on and off. Similarly, control screens 502 and 504 may include a light button 572 to turn any lights included on the infant device on and off.

One example of the present invention comprises using Bluetooth (or Bluetooth Low Energy (LE), Bluetooth Smart, etc.) connectivity to connect a remote infant device to an app on a Smart Device (e.g., iOS Device, Android device, etc.), and provide two-way communication and control. The app and data connection can then be used in a number of possible ways, including (but not limited to): App control of the remote infant device, telemetry from the infant device, customization of the operation of the infant device.

One possible hardware example includes a Bluetooth module installed in the infant device at manufacture (either as a manufacturer installed module, or directly incorporated into the infant device's electronics), giving the user a connected experience "out-of-box." Another possible hardware example includes a Bluetooth module that is sold as an accessory item, and is added to an existing infant device as a user installed accessory item. In this example the accessory may be a "black box" that connects between the infant device battery/power adapter and its connection point on the infant device. Further, in this example, the accessory may be designed to be used in any existing infant device. These examples are not meant to limit the possible hardware configuration embodiments, but provide two possible examples. For example, a Bluetooth Smart module may be added to an existing infant receiving device and directly connected to the existing infant receiving device electronics in parallel with the existing control buttons and swing setting controls.

As a summary, the software of the app 320 may include numerous features, including, but not limited to: function(s) to control some or all of the infant device controls that are available on the infant device control panel (e.g., the app 320 may contain a representation of the infant device control panel in its user interface, and a the smart device 120 user can interact with the on-screen controls and remotely control those same control functions on the actual infant device); main power disable/enable switch allowing the smart device user to disable/enable power to the infant receiving device; infant device battery level (gas-type gauge) allowing the smart device user to view the battery voltage level on the infant device at any time; infant device motor speed data allowing the smart device user to view the actual speed at which the infant receiving device is moving; receive audio from the infant device allowing the smart device user to hear input (e.g., a child talking, etc.) from a microphone on the infant device; send audio to the infant device allowing the smart device user to talk to the child via the infant device as well as stream music/audio content from the smart device to a speaker in the infant device; baby cry/activity detector output from electronics on the infant device which is forwarded to the app on the smart device; alarm based on data from the infant device (e.g., cry detector, baby activity, swing stalled, etc.); baby weight data gathered from a weight gauge on the infant device to be displayed on the app; customization functions to automatically perform certain functions based on telemetry form the infant device (e.g., if the infant device detects a crying baby, the app can automatically turn the infant device to speed 2, and play music for the baby); customization functions allowing the user to choose or record audio that plays when the infant device runs (e.g., play a soothing sound with the infant device is moving); data storage of infant device use data (e.g., how long the infant device is used per day, how often the infant device is used, etc.) that may be used by either the user or the manufacturer to analyze usage; learning functions that learn what infant device settings the parent usually uses for later use as default settings; learning functions based on telemetry from the infant receiving device and device usage (e.g., when the cry detector detects a crying baby, the app can set the infant receiving device to perform different speed settings, different music settings, etc., and detect and store which settings cause the baby to stop crying).

One specific example of an iOS app 320 for use with the present invention includes, but is not limited to, the following user interface elements: a connect button used to pair the iOS device with the Bluetooth module, a swing speed up button, a swing speed down button, an audio volume up button, an audio volume down button, a music on/off button, a sound effects on/off button, a mobile on/off button, swing speed "LEDs" (e.g., a row of light emitting devices that appear on the app's user interface that give a representation of the swing speed LEDs on the control panel of the swing), a baby cry indicator (e.g., a light on the app's user interface that illuminates when the baby cry detector circuit in the swing detects a crying baby).

As mentioned, in some embodiments, the iOS app may simply minor any controls physically included on an infant device. As an example of one infant device arrangement, FIG. 9 provides a block diagram representing a schematic of the controls and electronics of an exemplary swing 100 in accordance with the present invention. As can be seen, the swing includes an integrated circuit or processor 702 which is electronically coupled to a wireless communication module 710 (e.g. a Bluetooth LE or Bluetooth Smart transmitter/receiver) with an antenna 712, a power source 720 with a main power switch 722, a swing motor and controller 730, a mobile drive and controller 740, and a control panel 750. In this embodiment, the control panel includes various switches to control the swinging motion of the swing, the audio output and volume, and the attached mobile. Specifically, the control panel 750 includes the following switches: swing speed increase 751, swing speed decrease 752, volume increase 753, volume decrease 754, music type #1 755, music type #2 756, sound effects 757, and mobile on/off 758. In other embodiments, the control panel 750 may include any desirable switches to include any desirable functions of the infant device.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A method for providing bidirectional communication between an infant receiving device and a hand-held portable electronic device, the method comprising:

establishing a wireless connection between the infant receiving device and the hand-held portable electronic device;

monitoring an infant environment of an infant received in the infant receiving device for at least one of a sound or a movement; and creating a message directed toward the hand-held portable electronic device upon detection of the at least one sound or movement, the message including at least status information of the infant environment;

upon creation of the message, transmitting a push notification including the message from the infant receiving device to the hand-held portable electronic device across the wireless connection, wherein the push notification causes the hand-held portable electronic device to display a mirrored version of controls physically included on the infant receiving device that enables at least one user command to be sent from the hand-held portable electronic device to the infant receiving device over the wireless connection.

2. The method of claim 1, wherein the at least one user command received from the hand-held portable electronic device comprises at least one of a command to the infant receiving device for initiating actions, audio data, and video data.

3. The method of claim 1, wherein the message further comprises at least one of audio data, video data, and data regarding an infant received in the infant receiving device.

4. The method of claim 1, further comprising:

receiving and storing the at least one user command; and associating the at least one stored user command with the push notification to which the at least one stored user command responded.

5. The method of claim 4, wherein associating further comprises:

associating the at least one user command with a condition present in the infant environment at the time the at least one user command is received by the infant receiving device.

6. The method of claim 1, wherein the hand-held portable electronic device is a smartphone, and the at least one user command is generated via an application stored on the smartphone.

7. The method of claim 1, wherein the infant receiving device comprises a sensor module and the at least one user command is preprogrammed to be sent in response to a particular input from the sensor module.

8. A bidirectional wireless communication system comprising:

a smartphone comprising a first wireless communication module, and an I/O interface;

a first infant receiving device comprising a second wireless communication module, a first control module, and at least one module selected from the group of an effect module and a sensor module;

a second infant receiving device, the second infant receiving device comprising a third wireless communication module and a second control module;

wherein the first wireless communications module establishes a first wireless connection with the first infant receiving device via the second wireless communications module and establishes a second wireless connection with the second infant receiving device via the third wireless communication module, and wherein the smartphone receives push notifications over the first wireless connection and the second wireless connection and, upon receiving a push notification, displays a mirrored version of controls physically included on the infant receiving device from which the push notification was received, and the mirrored version of the controls enables commands to be sent over the first wireless connection or the second wireless connection, such that the smartphone can continually monitor and individually control the first infant receiving device and the second infant receiving device.

9. The system of claim 8, wherein the second wireless communication module is formed within the first control module of the first infant receiving device.

10. The system of claim 8, wherein the second wireless communication module is a user-installed accessory item added to the first infant receiving device.

11. The system of claim 8, wherein the-smartphone sends commands to and receives the push notifications from the second wireless communication module and the third wireless communication module via an application included on the smartphone.

12. The system of claim 8, wherein the sensor module is configured to monitor an infant environment in the first infant receiving device for at least one of sounds and movement, wherein the push notifications sent to the smartphone include messages relating to at least one of detected sounds and detected movement.

13. The system of claim 8, wherein the sensor module is configured to monitor activity of the first infant receiving device and wherein the push notifications sent to the smartphone include messages relating to feedback of detected activity.

14. The system of claim 8, wherein the commands sent from the smartphone to the first infant receiving device and the second infant receiving device include at least one of a video transmission, an audio transmission, and control instructions.

15. A method for remotely controlling two or more infant receiving devices, the method comprising:

establishing a first wireless connection between a first infant receiving device and a smartphone;

establishing a second wireless connection between a second infant receiving device and the smartphone;

receiving at the smartphone at least one first message from the first infant receiving device and at least one second message from the second infant receiving device;

in response to receiving the first message, displaying a mirrored version of controls physically included on the first infant receiving device that enables a user to input a first plurality of commands at the smartphone;

sending the first plurality of commands from the smartphone to the first infant receiving device via the first wireless connection;

in response to receiving the second message, displaying a mirrored version of controls physically included on the second infant receiving device that enables a user to input a second, different, plurality of commands at the smartphone; and sending the second plurality of commands from the smartphone to the second infant receiving device via the second wireless connection.

16. The method of claim 15, further comprising:

receiving, at the smartphone, manually input commands on the mirrored version of the controls physically included on the first infant receiving device; and receiving, at the smartphone, manually input commands on the mirrored version of the controls physically included on the second infant receiving device.

17. The method of claim 16, wherein the first plurality of commands and the second plurality of commands are manually input through a software application loaded on the smartphone.

* * * * *